United States Patent [19]

Gies et al.

[11] Patent Number: 4,784,557

[45] Date of Patent: Nov. 15, 1988

[54] CUP OR COVER STACKER OF A CUP FILLING APPARATUS FOR DAIRY PRODUCTS

[75] Inventors: Burkhard Gies, Wuppertal; Berthold Lingenhoff, Hilden, both of Fed. Rep. of Germany

[73] Assignee: Hamba-Maschinenfabrik Hans A. Muller GmbH & Co. KG, Wuppertal, Fed. Rep. of Germany

[21] Appl. No.: 58,139

[22] Filed: Jun. 4, 1987

[30] Foreign Application Priority Data

Jun. 12, 1986 [DE] Fed. Rep. of Germany ..... 3619760

[51] Int. Cl.[4] ..... B65G 57/03; B65G 59/06

[52] U.S. Cl. ..... 414/45; 198/625; 198/627; 198/688.1; 414/79; 414/129; 414/130

[58] Field of Search ..... 414/30, 43, 45, 69, 414/78, 79, 81, 115, 129, 130; 198/625, 626, 627, 628, 688.1; 221/77, 222, 297

[56] References Cited

U.S. PATENT DOCUMENTS

| | | | |
|---|---|---|---|
| 1,746,697 | 2/1930 | Eaglesfield | 198/628 |
| 2,556,740 | 6/1951 | Polsen et al. | 221/222 |
| 3,122,230 | 2/1964 | Bogue | 414/69 X |
| 3,533,517 | 10/1970 | Heide | 414/45 |
| 3,741,410 | 6/1973 | Henschke et al. | 414/129 |
| 4,260,311 | 4/1981 | Hanses | 414/129 |
| 4,547,114 | 10/1985 | Watrous et al. | 414/81 |
| 4,558,802 | 12/1985 | Molison | 221/222 X |

FOREIGN PATENT DOCUMENTS

| | | | |
|---|---|---|---|
| 2235962 | 3/1973 | Fed. Rep. of Germany | 198/625 |
| 721573 | 11/1966 | Italy | 198/626 |

*Primary Examiner*—Leslie J. Paperner
*Attorney, Agent, or Firm*—Herbert Dubno

[57] ABSTRACT

A cup and/or cover strand can be fed with the cup and/or cover feed device according to our invention, especially a cup and/or cover feed device of a cup filling unit for nutrient and palatable items such as dairy products. The cup and/or cover edges of the cup and/or cover strand are gripped and held by circumferential screw threads on substantially vertical axially parallel rotating spindle heads of a separating device and are divided into magazine suitable cup and/or cover partial stacks. The cup and/or cover partial stacks are deposited and supported on a horizontal conveyor spaced from and below the separating device. At least one vertical conveyor with downwardly moving recesses is provided on each side of the horizontal conveyor connected with the separating device and bridging the space between the separating device and the horizontal conveyor. The recesses hold the cover and/or cup edges and are provided in an axial region appropriate for the partial stack. The vertical conveyors are spacable transversely from each other to release the horizontal conveyor. The cup and/or cover feed device makes magazine suitable and processable, particularly loose and axially aligned, cup and/or cover partial stacks.

9 Claims, 3 Drawing Sheets

CUP OR COVER STACKER OF A CUP FILLING APPARATUS FOR DAIRY PRODUCTS

FIELD OF THE INVENTION

Our present invention relates to a cup or cover (lid) stacker and, more particularly, to a cup or cover stackers for a cup filling apparatus for comestible items such as dairy products.

BACKGROUND OF THE INVENTION

A cup or cover stacker is known, particularly for a multirack cup filling apparatus for comestible items such as dairy products, in which a more or less continuous cup or cover column, i.e. column of lids or cups adapted to form a packaging container together, is divided into cup or cover partial stacks which are deposited on a horizontal conveyor positioned with clearance beneath a separating device by axially parallel spindle heads of the separating device engaging the cover or cup edges by circumferential scew threads.

In the known cup or cover stacker a theoretically unending cup or cover column is processed.

The cup or cover column is easily manipulatable because of its flexibility and is conveyed over spatially curved guides formed, e.g. by rods.

The separating device having four spindle heads provided on its delivery side has as its purpose to divide the cup or cover column into magazine-suitable partial stacks in which the cups or covers can be nested relatively firmly in one another.

Magazine-suitable means that the rows of partial stacks must be provided with the same number of partial stacks as the number of cup feed paths in the cup filling machine. In a four path cup filling apparatus, therefore, four partial stacks must be formed corresponding to the four cup or cover magazines (see our copending application Ser. No. 07/058,164, filed concurrently herewith (based upon German Patent document No. 3 619 519).

As soon as a certain partial stack height has been reached the separating device is stopped so that the spindle head prevents further unintended cup or cover dropping. While the separating device is idle the horizontal conveyor for transport of the partial stack is stepped.

In the known cup or cover stacker the separating device has the purpose of providing magazine-suitable partial stacks in which the covers or cups can sit on each other comparatively loosely for complication-free further processing which is not the case in the case with the normal cup or cover columns processed by the stacker.

Disadvantageously in the known cup or cover stacker after leaving the separating device a cup or cover travels to the horizontal conveyor by free fall. The partial stack formed by free fall can have inexactly or imprecisely positioned covers or cups, since the cup—particularly the cover—can be axially slid or tilted which can lead to trouble on further processing in subsequent removal from the magazine.

Mention may be made of U.S. Pat. No. 2,556,740 which discloses a system preventing free fall of cups but which does not fully solve the problems outlined above.

OBJECTS OF THE INVENTION

It is an object of our invention to provide an improved cup or cover stacker for a cup filling apparatus which can avoid these drawbacks.

It is also an object of our invention to provide an improved cup or cover stacker for a cup filling apparatus with which partial cup or cover stacks are formed which are satisfactory for further processing.

SUMMERY OF THE INVENTION

These objects and others which will become more readily apparent hereinafter are attained in accordance with out invention a cup or cover stacker, particularly for a cup filling apparatus for comestible items such as dairy products, in which a cup or cover column is divided into a plurality of partial cup or cover stcks which are deposited on a horizontal conveyor positioned with clearance beneath a separating device formed with a plurality of axially parallel spindle head of the separating device engaging the cover or cup edges by circumferential screw threads.

According to our invention each side of the horizontal conveyor is provided below the separating device with at least one vertical conveyor connected with the separating device with a plurality of downwardly moving recesses which engage and hold the cup or cover edges and which are provided in an axial region appropriate for the partial stack and the vertical conveyors are displaceable transversely from each other to clear the deposited stack and permit unimpeded travel of the stacks on the horizontal conveyor.

The characteristic structures of our invention prevent the free fall of cups or covers after leaving the separating device.

A vertical conveyor (downwardly directed conveyor) or a plurality conveyors is or are provided on both sides of the horizontal conveyor which according to the desired axial region of the partial stack take and feed the cup or covers downwardly in succession axially so that a loose axially directed partial stack arises.

As soon as the desired partial stack height is attained as a result of their connection both the separating device and the vertical conveyors are stopped.

After they are halted, the vertical conveyors are moved laterally from the separating device so that the latter can be stepped to transport away the partial stack provided to it unimpeded.

After that the vertical conveyors again are approached to the separating device so that a fresh partial stack can be built.

Various vertical conveyors are possible within the scope of our invention. Thus, for example, two feed spindles with substantially vertical axes parallel to each other positioned on opposite sides of the horizontal conveyor can be provided as the vertical conveyor. The circumferential screw thread of these feed spindles forms the recesses which engage the cup or cover in this example.

In a particularly preferred embodiment of our invention when each vertical conveyor has a circumferentially guided feed means moving between two horizontal rotation axes whose downward columns facing the partial stack from the recesses engaging the cup or covers. Although toothed belts are also basically suitable as circulating feed means, roller chains have proven particularly advantageous. An upper and lower sprocket wheel can be provided around which the feed means or roller chain circulates.

Other specific examples are possible with a variety of features. The upper sprocket wheel can be positioned approximately at the same height as the spindle head. The upper and lower sprocket wheel can be mounted on a pivot arm which is pivotable about a bearing of the lower sprocket wheel. the pivot arm can have a substantially vertical, advantageously plastic, guiding surface or strip supporting the rollers of the roller chain on a peripheral portion of the pivot arm facing the partial cup or cover stacks for guiding the roller chain verticaly. The vertical conveyors positioned on both sides of the horizontal conveyor can each have an upper and a lower sprocket wheel axis or shaft which are provided on both ends with one of the sprocket wheels. All of the guided circulating feed means moving uniformly are advantageously coupled with each other.

BRIEF DESCRIPTION OF THE DRAWING

The above and other objects, features and advantages of our invention will become more readily apparent from the following description, reference being made to the accompanying highly diagrammatic drawing in which.

SPECIFIC DESCRIPTION

Figure 1:
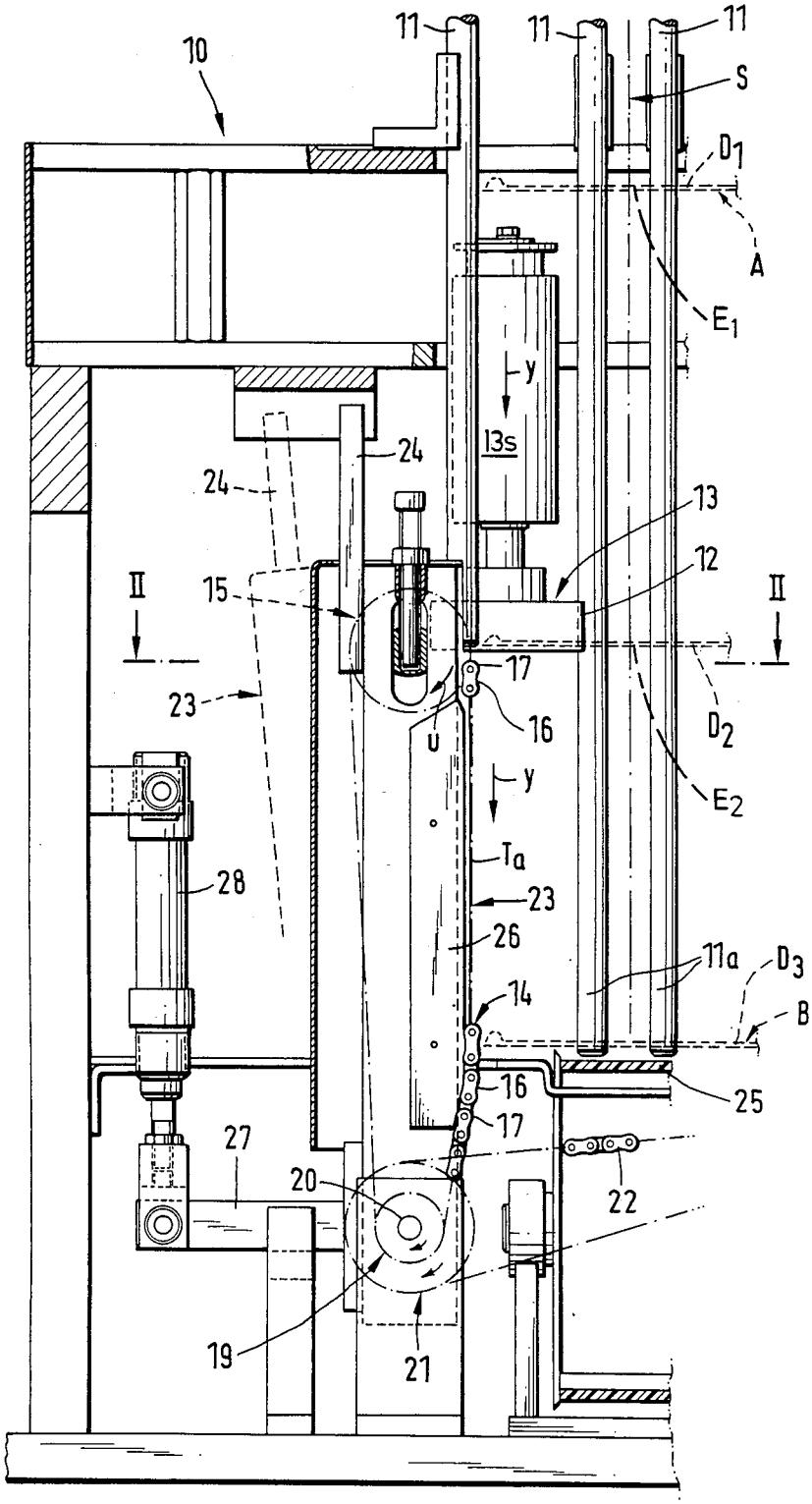
FIG. 1 is a partial vertical cross sectional veiw through a cup or cover stacker according to our invention.
Figure 2:
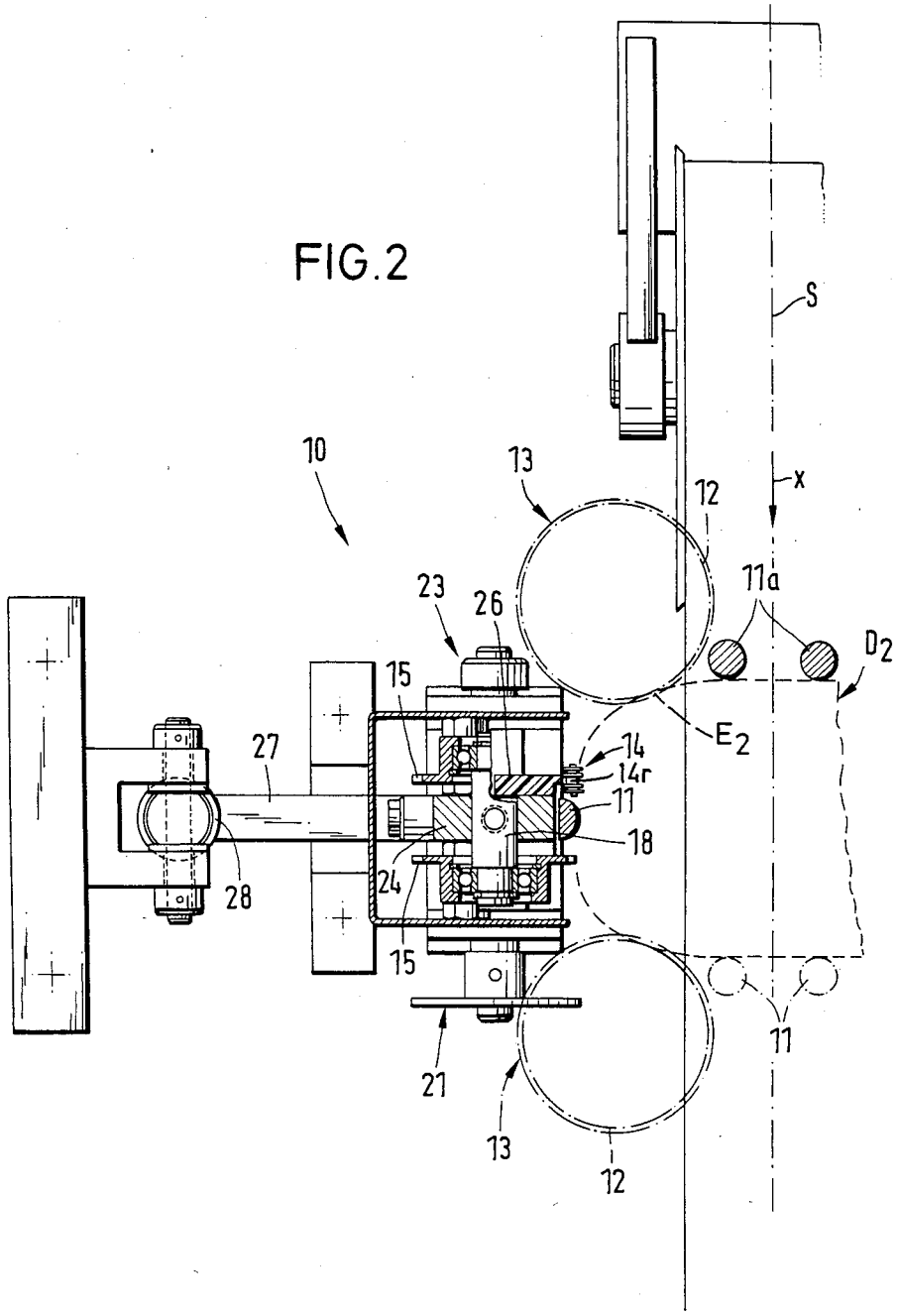
FIG. 2 is a partial horizontal cross sectional view through the device taken along the section line II—II of FIG. 1.
Figure 3:
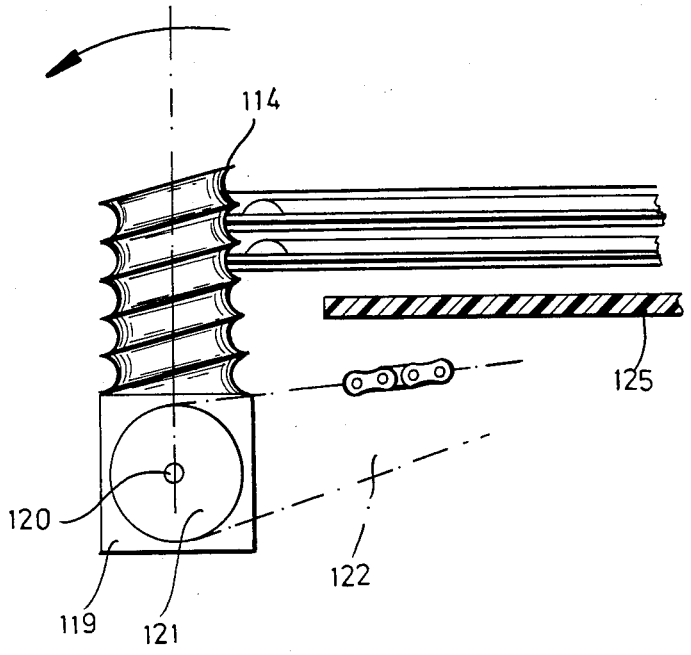
FIG. 3 is a partial vertical cross sectional view through an alternative embodiment of a cup or cover stacker according to our invention.

Only half the cup or cover stacker 10 according to our invention shown in FIGS. 1 and 2 is shown for simplicity of illustration. Of course the portion of the device to the left of the symmetry plane S is substantially a mirror image of the portion of the device to the right of the symmetry plane S.

The covers or lids indicated with dashed lines in FIGS. 1 and 2 are provided with reference characaters $D_1$, $D_2$ and $D_3$.

The cover $D_1$ forms a part of a cover column A fed into a cover guide 11 of which instead of all other covers contained in this cover column A only the cover $D_1$ is shown.

Now each cover edge $E_1$ or $E_2$ or $E_3$ is gripped on the delivery side by the screwthreads 12 provided on the outer circumference of four spindle heads 13 and is again fed axially along the vertically downward direction y.

Only one spindle head 13 is seen in FIG. 1 while two spindle heads 13 are indicated in FIG. 2.

The spindle heads 13 are mounted on substantially cylindrical feed spindle 13*s* one of which is shown in FIG. 1. These feed spindle 13*s* are generally axially parallel with each other and substantially vertically oriented.

FIGS. 1 and 2 show a cover $D_2$ with a portion of its edge $E_2$ gripped by the screwthreads 12 of spindle heads 13, held and fed downwardly in the direction y.

From FIG. 1 it is also seen that an exteriorly curved roller chain 14 circulated in the rotation direction U over the sprocket wheel 15 can reach the motion path of the cover $D_2$ and can grasp the cover $D_2$ on the spindle head 13 on the cover edge $E_2$ and hold it in a recess 16.

To receive the edge $E_2$ of one of the covers $D_2$ each side bar 17 of the roller chain 14 is provided with an inwardly indented or baylike section which forms the recess 16 shown in the drawing.

From FIG. 2 it is apparent that two sprocket wheels 15 are provided on an upper rotation axis 18 for receipt of two roller chains 14, only one of which is shown in FIG. 2.

The lower sprocket wheel 19 (only one is shown in FIG. 1) is mounted similar to the sprocket wheel 15 according to FIG. 2 on a drive shaft 20 on which a drive pinion 21 sits. This meshes with a drive chain 22 which simultaneously drives the not-illustrated other vertical conveyor chain (apparent from the symmetry of the device referred to above) which is similar to the vertical conveyor indicated with the reference character 23 and shown in FIGS. 1 and 2.

A pivoting arm 24 is seen on which both the upper rotation axis 18 and also the lower drive shaft 20 (both rigidly connected with each other) are mounted.

The pivoting arm 24 is now pivotable exteriorly about the lower drive shaft 20 so that the entire vertical conveyor 23 can take the left swung out position indicated with dashed lines in FIG. 1.

For parallel guiding of the roller chain 14 a plastic guide strip 26 is mounted on the pivoting arm 24. The rollers 14r of the roller chain 14 are supported on their sides facing away from the partial stack B by the guide strip 26.

To operate the pivoting arm 24 a drive lever 27 is provided which is acted on by an air cylinder 28.

The operation of the cup or cover stacker according to our invention is as follows:

The cover fed in a comparatively rigid column (cover $D_1$) is loosened and separated (cover $D_2$) with the help of the four spindle heads 13. Each indiviual cover $D_2$ in the delivery region (in the region of the vertical conveyor 23 in FIG. 1) follows the motion path of the covers $D_2$ and engages in the downwardly moving column $T_a$ and the recess (bay shaped indentation) 16 of the roller chain 14.

The spindle heads 13 continuously separate the covers so that the covers are guided downwardly in succession by the uniformly moving roller chain 14 driven connected with the spindle head 13.

This occurs until the lowermost cover has reached the position $D_3$ shown in FIG. 1 and is on the surface of the horizontal conveyor 25 which is a carrier belt.

To feed the covers moving downwardly in the direction y (FIG. 1) the twin guide rods 11a provided only on one side upstream relative to the horizontal feed direction x of the horizontal conveyor 25 are helpful.

As soon as—as shown—the partial stack B is formed on the horizontal conveyor 25 the spindle head 13 (and with it the vertical conveyor 23) stops and the horizontal conveyor 25 feeds partial cover stack B (not shown in detail) to the delivery magazine of the likewise not shown cup filling machine (see the aforementioned application which is incorporated in its entirety by reference).

So that the conveying flow of the horizontal conveyor 25 is not hindered both vertical conveyors 23 pivot to the outside into the position shown by the dashed line in FIG. 1.

By definition the separating device according to our invention includes the spindle heads 13 with their screwthreads 12.

The roller chain 14 of the particular example described in this specific description is one example of a guided circulating feed means. Other possible examples of a feed means would include belts with gripping elements attached circulating in place of the roller chain 14. By definition the circulating feed means is a circulating member which grips engages and holds the covers or cups and transports them to the horizontal conveyor 25.

FIG. 25 shows an alternative embodiment of the cup/and or cover stacker in which the chains are replaced by spindle 114 driven by a gear box 119 from the drive sprocket 121 and chain 122. The spindles 114 can be swung outwardly with the gear box 119 about the axis 120 of the sprocket 121 to clear the stack formed on the conveyor 125.

We claim:

1. A feeder for identical stackable articles having respective rims, particularly for cups or lids or dair product containers, comprising:

means for retaining a vertical column of said articles in which said articles rest upon one another;

separating means for dividing said column into a succession of individual ones of said articles, said separating means including a pair of horizontally spaced spindle heads at the base of said column rotatable about respective mutually parallel vertical axes and having helical formations engaging said rims to separate said articles individually from said stack upon rotation of said spindle heads;

a horizontal conveyor located directly below said column and vertically spaced from said spindle heads;

a pair of vertical conveyors flanking said horizontal conveyor and bridging the vertical spacing between said spindle heads and said horizontal conveyor and formed with succession of downwardly movable recesses each shaped to receive a rim of a respective one of said article for guiding said articles downwardly onto said horizontal conveyor;

drive means for operatively coupling said separating means with said vertical conveyors for synchronous rotation of said spindle heads and downward movement of said recesses; and means for swinging said vertical conveyors apart at least at said horizontal conveyor and in response to interruption of operation of said drive means to shift said vertical conveyors out of a path of articles on said horizontal conveyor and enable unhindered operation thereof.

2. The improvement according to claim 1 wherein two feed spindles vertically axially parallel with each other are provided on both sides of said horizontal conveyor as said vertical conveyors, circumferential screwthreads of which form said recesses.

3. The feeder defined in claim 1 wherein the vertical conveyors are endless elements formed with said recesses and passing over upper and lower guides rotatable about horizontal axes.

4. The feeder defined in claim 3 wherein said vertical conveyors are mounted upon supports swingable about horizontal axes and said means for displacing said vertical conveyors is operatively connected to said supports for swingably displacing same.

5. In a cup or cover stacker, particularly for a cup filling apparatus for comestible items such as dairy products, in which a cup or cover column is divided into a plurality of partial cup or cover stacks which are deposited on a horizontal conveyor positioned with clearance beneath a separating device for said cup or cover column by a plurality of axially parallel spindle heads of said separating device engaging the cover or cup edges of said cup or cover column by circumferential screwthreads, the improvement wherein each side of said horizontal conveyor is provided with at least one vertical conveyor connected with said separating device, said vertical conveyor having a plurality of downwardly moving recesses which engage and hold said cup or cover edges and which are provided in an axial region appropriate for said partial cup or cover stacks, and means are provided whereby said vertical conveyors are displaceable transversely away from each other, each of said vertical conveyors having a guided circulating feed means moving between two horizontal rotation axes whose downwardly moving columns facing said partial cup or cover stack form said recesses, said circumferentially guided feed means comprising a roller chain running over an upper and a lower sprocket wheel whose chain side plates facing said partial cup or cover stack form said recesses, said upper sprocket wheel being positioned approximately at the same height as said spindle heads, said upper and said lower sprocket wheels are mounted on a pivot arm which is pivotable about a bearing of said lower sprocket wheel.

6. The improvement according to claim 5 wherein said pivot arm has a substantially vertical plastic guiding surface supporting the rollers of said roller chain on a peripheral portion of said pivot arm facing said partial cup or cover stacks for guiding said roller chain vertically.

7. The improvement according to claim 5 wherein said vertical conveyors positioned on both sides of said horizontal conveyor each have upper and lower sprocket wheel axes or shafts which are provided on both ends with one of said sprocket wheels.

8. The improvement according to claim 5 wherein all of siad circulating guided feed means moving uniformly are coupled with each other.

9. A cup or cover stacker, particularly for a cup filling apparatus for comestible items such as dairy products, comprising:

a separating device which divides a cup or cover column into a plurality of partial cup or cover stacks having a plurality of axially parallel spindle heads engaging the cover or cup edges of said cup or cover columns by circumferential screwthreads;

a horizontal conveyor positioned with clearance beneath said separating device upon which said plurality of partial cup or cover stacks are deposited;

at least one vertical conveyor connected with said separating device positioned on each side of said horizontal conveyor having a plurality of downwardly moving recesses which engage and hold said cup or cover edges and which are provided in an axial region appropriate for said partial cup or cover stacks, each of said vertical conveyors including a roller chain running over an upper and a lower sprocket wheel whose chain side plates facing said partial cup or cover stack form said recesses, said upper sprocket wheel being positioned approximately at the same height as said spindle heads; and a pivot arm on which said upper and said lower sprocket wheels are mounted which is pivotable about a bearing of said lower sprocket wheel and which has a substantially vertical guiding surface supporting the rollers of said roller chain on a peripheral portion of said pivot arm facing said partial cup or cover stacks for guiding said roller chain vertically.

* * * * *